US009332872B1

(12) United States Patent
Eldridge

(10) Patent No.: US 9,332,872 B1
(45) Date of Patent: May 10, 2016

(54) CARPET TACK STRIP WORKING TOOL

(71) Applicant: Ulysses Eldridge, Council Grove, KS (US)

(72) Inventor: Ulysses Eldridge, Council Grove, KS (US)

( * ) Notice: Subject to any disclaimer, the term of this patent is extended or adjusted under 35 U.S.C. 154(b) by 259 days.

(21) Appl. No.: 13/957,939

(22) Filed: Aug. 2, 2013

(51) Int. Cl.
*A47G 27/04* (2006.01)
*B25F 1/00* (2006.01)

(52) U.S. Cl.
CPC ..... *A47G 27/0487* (2013.01); *B25F 1/006* (2013.01)

(58) Field of Classification Search
CPC ..... B25D 1/06; B25D 1/12; B25D 1/14; B25G 3/34; B25C 7/00; A47G 27/0487; B25F 1/006
USPC ..... 7/103, 144, 145; 81/26, 44
See application file for complete search history.

(56) References Cited

U.S. PATENT DOCUMENTS

| | | | | | |
|---|---|---|---|---|---|
| 158,835 | A * | 1/1875 | Erlin | 7/144 |
| 3,166,757 | A * | 1/1965 | Downs, Jr. | 81/44 |
| 3,685,064 | A * | 8/1972 | Cuscovitch, Sr. | 7/103 |
| 3,790,976 | A * | 2/1974 | Stencil | 7/103 |
| 5,647,080 | A * | 7/1997 | Martin | 7/103 |
| D385,470 | S * | 10/1997 | Martin | D8/89 |
| 2013/0126807 | A1 * | 5/2013 | Lombardi et al. | 81/20 |

* cited by examiner

*Primary Examiner* — Hadi Shakeri
(74) *Attorney, Agent, or Firm* — Kenneth H. Jack; Davis & Jack, L.L.C.

(57) ABSTRACT

A carpet tack strip working tool including a rigid bar having longitudinal, oppositely longitudinal, upper, and lower ends; handle means attached to the rigid bar's oppositely longitudinal end; first, second, and third strike faces, the first and second strike faces being adapted for nailing, and the third strike face being adapted for hammer striking; first, second, and third strike face mounts respectively attaching the first, second, and third strike faces to the rigid bar, the first strike face mount downwardly extending the first strike face from the bar's longitudinal end, the second strike face mount downwardly extending the second strike face from the bar's oppositely longitudinal end, and the third strike face mount upwardly extending the third strike face from the bar's oppositely longitudinal end; and a downwardly opening finger protection concavity defined by the first and second strike face mounts.

8 Claims, 5 Drawing Sheets

CARPET TACK STRIP WORKING TOOL

CLAIM OF PRIORITY FROM PREVIOUSLY FILED PROVISIONAL PATENT APPLICATION

This non-provisional patent application claims the benefit of and priority from U.S. Provisional Patent Application No. 61/681,978 filed Aug. 10, 2012. The inventor disclosed in said provisional application is the same person as the person who is disclosed as the inventor in the instant application. The applicant asserts that structures and functions of structures disclosed and described in the instant application are substantially identical to those disclosed in said provisional application.

FIELD OF THE INVENTION

This invention relates to hand tools. More particularly, this invention relates to hand tools which are adapted for assisting in installations of carpet tack strips upon floor surfaces.

BACKGROUND OF THE INVENTION

Professional installers of stretched or wall-to-wall carpeting commonly utilize a common claw hammer for nailing thin wooden carpet tack strips about the periphery of floor surfaces. In use of such hammers for such nailing tasks, level nail head striking swings of the hammer's handle and hammerhead must be repeatedly executed close to the floor's surface. Such hammering action near a floor surface commonly swings a carpet layers, fingers, and knuckles into close proximity with the floor surface, and such motion often undesirably and painfully results in erroneous forceful contacts between the floor and the fingers and knuckles.

Also in use of such claw hammer for carpet tack strip installation, the carpet layer often needs to trim to length a segment of carpet tack stripping in order to complete a strip extension to a wall. When such need for cutting a carpet tack strip to length arises, the carpet layer is commonly required to set aside a claw hammer and to retrieve for use a separate wood cutting tool such as shears, side cutters or a saw. Following usage of such separate wood cutting tool, the carpet layer must set aside the wood cutting tool, and retrieve the claw hammer for resumption of floor nailing of the specially sized carpet tack strip segment. Such steps of settings aside and retrievals of a separate cutting tool undesirably reduce costs economies by requiring the purchase and maintenance of a separate wood cutting tool, and the additional steps undesirably increases time and effort dedicated to the tool setting aside and retrieval steps.

Further drawbacks and deficiencies relating to a carpet layer's use of a common claw hammer are recognized when the carpet layer works within a room including finished cabinets having floor level "toe kick" recesses. Such toe kick recesses advantageously allow an occupant of the room to closely approach a cabinet's countertop without allowing the occupant's shoe tips to impinge against the cabinet's base. Such recesses commonly have a horizontal depth between 2½-3½ inches, and have a vertical height between 3 inches and 3½ inches. Where wall-to-wall carpet is installed within a room including such toe kick equipped cabinets, the carpeting desirably extends into and covers floor surfaces within the recesses. Accordingly, carpet tack strips often are desirably installed within toe kick recesses. Since a common claw hammer cannot be effectively swung within a toe kick recess, a carpet layer seeking to install carpet tack stripping within such recess typically must set aside the claw hammer and utilize a specialized tool, such as a nail driver bar, to drive carpet tack strip nails within the recess. Similarly with the above described undesirable steps of setting aside and retrieving a cutting tool, utilization of a separate nail driver bar to drive nails within toe kick recess is undesirably uneconomical, requiring the further procurement and maintenance of a separate tool, and further wastes time, effort, and motion by requiring additional tool setting aside and retrieval steps.

The instant inventive carpet tack strip working tool solves or ameliorates the problems, defects, and deficiencies discussed above by providing a single specially configured tool which is capable of performing multiple functions of finger protected floor level tack strip nailing, toe kick space tack strip nailing, and tack strip cutting.

BRIEF SUMMARY OF THE INVENTION

A first structural component of the instant inventive carpet tack strip working tool comprises a rigid bar having longitudinal, oppositely longitudinal (or handle), upper, and lower ends. In a preferred embodiment, the rigid bar comprises durable carbon steel and has a length between 12 and 18 inches.

A further structural component of the instant inventive carpet tack strip working tool comprises handle means which are fixedly attached to or are formed wholly with the rigid bar's oppositely longitudinal end. In one of the preferred embodiments, the handle means comprise an overmolded and "U" channel configured length of durable synthetic rubber. Suitably, the handle means may alternatively comprise a wholly formed enlargement of a 5-8 inch length of the rigid bar's oppositely longitudinal end. Further alternatively, the handle means may comprise a steel shank within synthetic rubber overmolding which in the form of an "O" channel covers and protects all surfaces other than striking surfaces. The handle means may further alternatively comprise lateral and oppositely lateral hand grip forming plates which are riveted to lateral and oppositely lateral sides of the rigid bar's oppositely longitudinal end.

Further structural components of the instant inventive carpet tack strip working tool comprise first, second, and third strike faces, the first and second strike faces preferably being adapted for carpet tack strip nailing, and the third strike face preferably being adapted for receipts of hammer strikes. Correlating first, second, and third mounting means are preferably provided for fixedly attaching the first, second, and third strike faces to the rigid bar and for operatively positioning those faces with respect to the rigid bar.

In a preferred embodiment of the instant invention, the first mounting means are adapted to position the first strike face at the rigid bar's extreme longitudinal end and to downwardly extend the first strike face therefrom. The second mounting in a similar fashion rearwardly positions the second strike face at the rigid bar's extreme oppositely longitudinal end, and downwardly extend the second strike face therefrom. The first and second mounting means' respective downward extensions of the first and second strike faces from the rigid bar's longitudinal and oppositely longitudinal ends advantageously form, in combination with the rigid bar's lower end, a downwardly opening finger protection concavity. Upon use of the tool for nail driving at floor level, such concavity advantageously shields fingers and knuckles from impingements against the floor surface. The first and second mounting means preferably comprise first and second hammerhead and neck combinations, the neck components of such combinations preferably effecting the downward strike face extensions which define the tool's finger protection concavity.

In a preferred embodiment of the instant invention, the third strike face element comprises an upwardly exposed face positioned over the oppositely longitudinal end of the rigid bar. Where the handle means incorporate an overmolded "U" channel member, the third mounting means preferably upwardly position the third strike face along the "U" channel's upper opening. Alternatively, the third strike face element may comprise a shorter longitudinal extension which protrudes upwardly through an "O" channel configured overmolded synthetic rubber handle.

In use of the instant inventive carpet tack strip working tool, a carpet layer may grasp the handle of the tool in his or her hand. Upon grasping the tool, the carpet layer's fingers conventionally curl about the tool's handle with fingers advantageously residing within and extending through the tool's downwardly opening finger protection concavity. With hand and fingers so situated, the carpet layer may execute nail driving hammer strokes against carpet tack strip mounting nails which are situated at floor level without any injurious or abrading contact of fingers and knuckles against the floor surface. In the event of an erroneously low hammer stroke, the instant invention prevents injurious impingements of fingers against the floor by restricting the contact points with the floor to the tool's first and second strike faces, and by holding fingers and knuckles slightly above the floor between those faces.

In the event that the carpet layer wishes to nail a carpet tack strip within a cabinet's floor level toe kick recess, the oppositely longitudinal end of the tool may be inserted by the carpet layer into the recess, and the tool's second strike face may be placed in direct overlying contact with one of the tack strip's preset nails. The tool's longitudinal strike face may simultaneously rest against the floor to serve as a fulcrum or pivot point. Thereafter, the carpet layer may utilize a separate hammer to downwardly strike against the tool's upwardly oriented third strike face, simultaneously translating such striking force to the inventive tool's oppositely lateral end, to the tool's second strike face, and to the nail, advantageously driving the nail within the toe kick recess.

A preferred embodiment of the instant invention incorporates a fourth strike face which is specially configured for service as tack strip cutting edge. Fourth mounting means for positioning the fourth strike face at the tool's longitudinal end, and for upwardly extending the fourth strike face therefrom are preferably provided. In a preferred embodiment, the fourth mounting means comprise an adz blade which is fixedly attached to or formed wholly with the rigid bar's longitudinal end. Where the preferred adz blade edge configured fourth strike face is provided, a carpet layer may utilize the sharpened edge for cutting wooden carpet tack strips to length.

Accordingly, objects of the instant invention include the provision of a carpet tack strip working tool which incorporates structures as described above, and which arranges those structures in relation to each other in manners described above for the performance of functions, and achievement of benefits and advantages as described above.

Other and further objects, benefits, and advantages of the instant invention will become known to those skilled in the art upon review of the Detailed Description which follows, and upon review of the appended drawings.

DETAILED DESCRIPTION OF PREFERRED EMBODIMENTS

Figure 1:
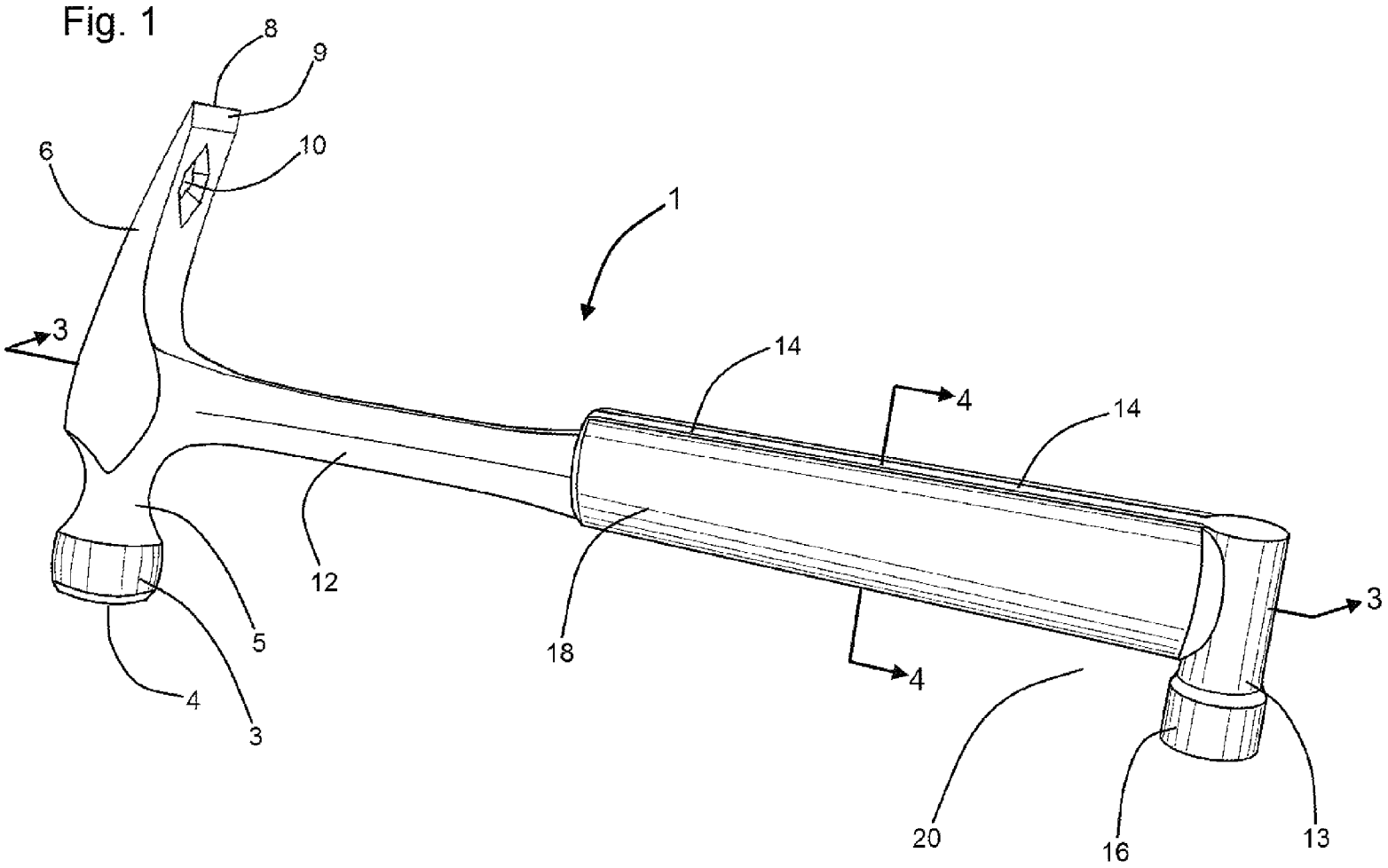
FIG. 1 is a perspective view of the instant inventive carpet tack strip working tool.
Figure 2:
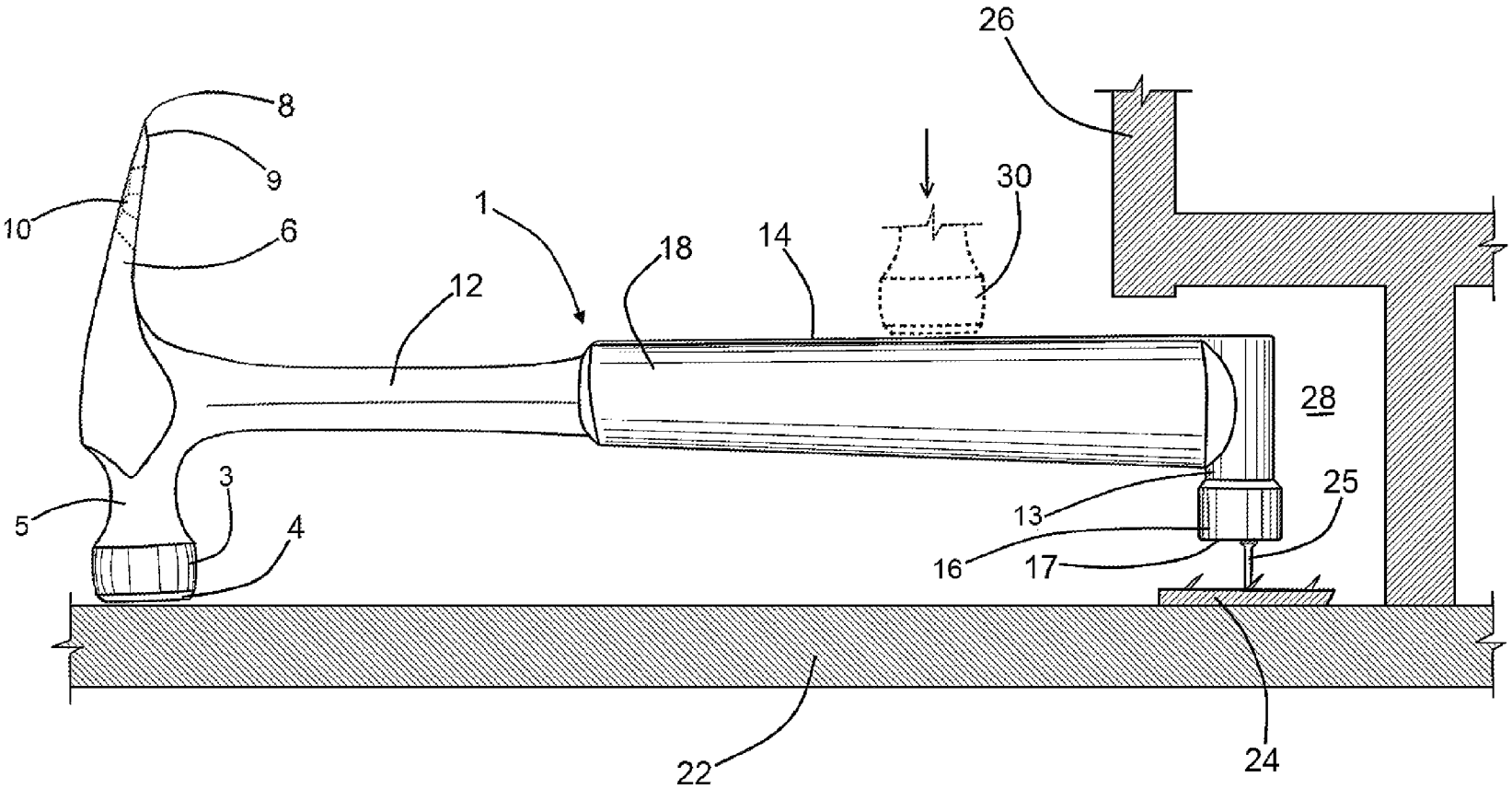
FIG. 2 includes a side view of the tool of FIG. 1, the view further showing in sectional view floor and cabinet structures, and showing in dashed lines a head of a separate hammer tool.
Figure 3:
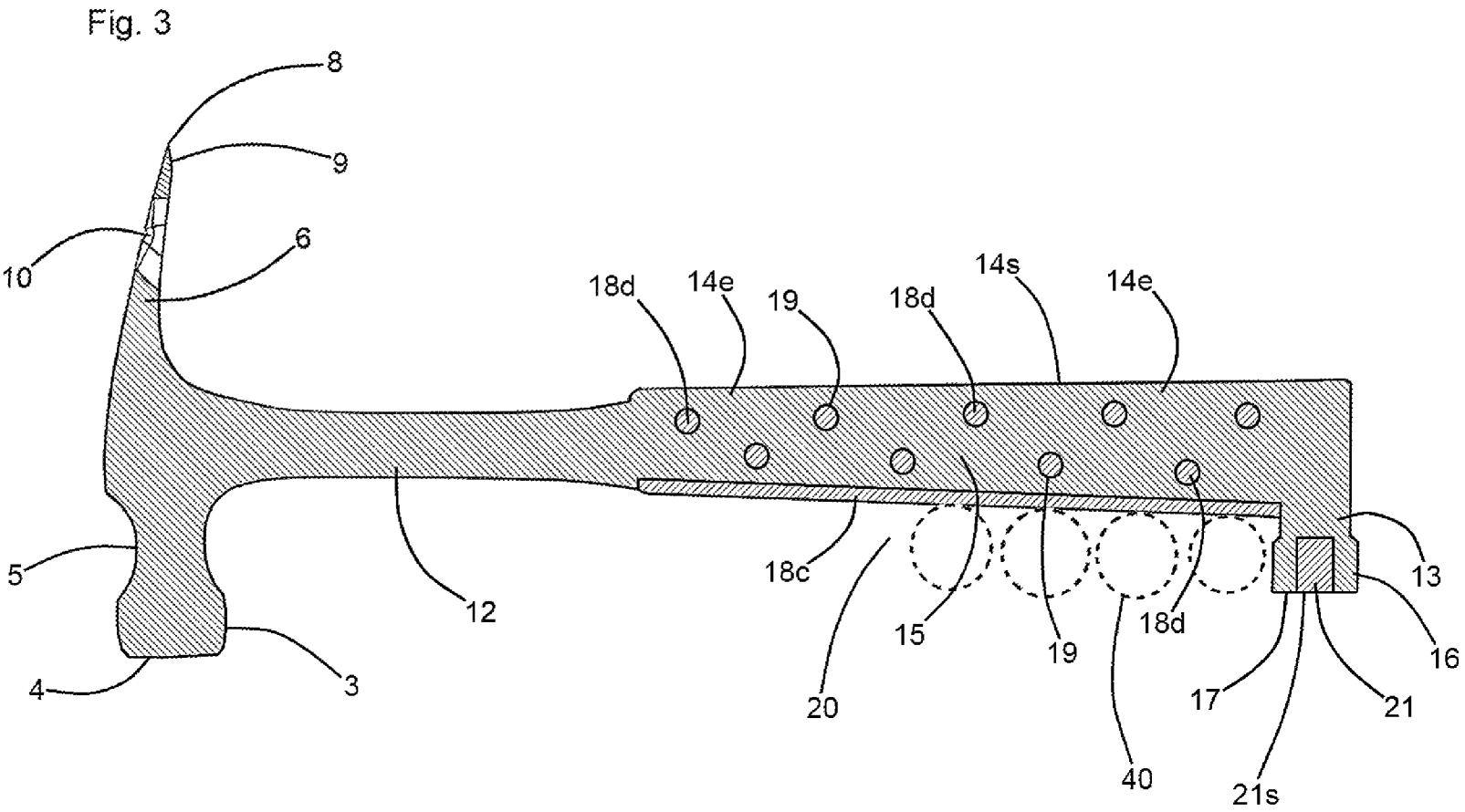
FIG. 3 is a sectional view as indicated in FIG. 1, the view showing in dashed lines the fingers of a hand grasping the tool.

Referring now to the drawings and in particular to Drawing FIGS. 1 and 3, a preferred embodiment of the instant inventive carpet tack strip working tool is referred to generally by Reference Arrow 1. A core structural component of the tool 1 comprises a rigid bar 12,15, reference Numeral 12 designating a longitudinal end of such bar and reference numeral 15 designating such bar's oppositely longitudinal or handle end. The rigid bar 12,15 is preferably composed of durable carbon steel.

Figure 4:
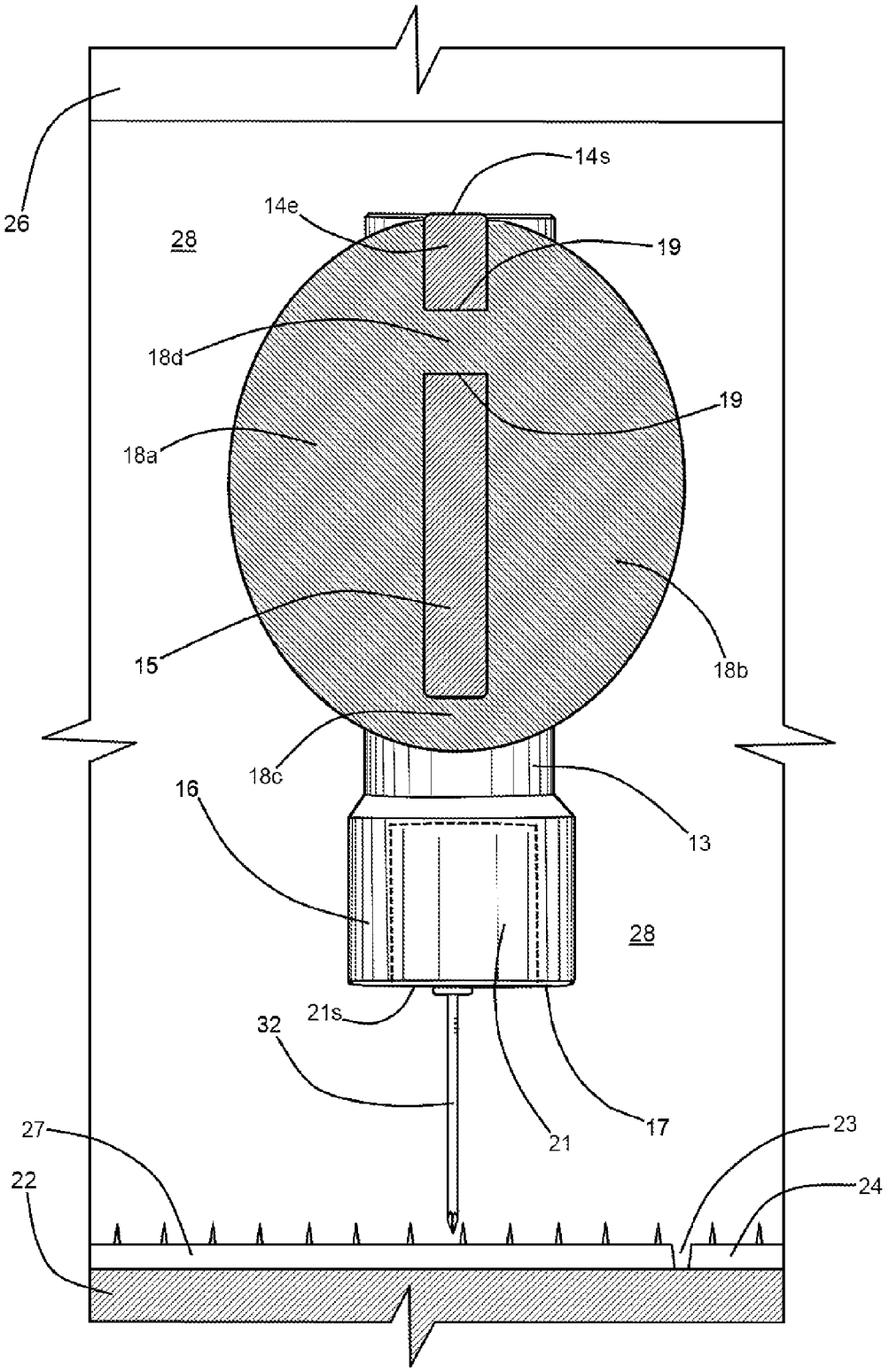
FIG. 4 presents an alternate sectional view as indicated in FIG. 1, the view additionally showing usage environment nail, cabinet, tack strip, and floor structures.

Referring simultaneously to FIGS. 1, 3, and 4, the tool 1 preferably further comprises handle means which are referred to generally in FIG. 1 by Reference Numeral 18, and which are referred to in particular in Drawing FIGS. 3 and 4 by Reference Numerals 18*a*, 18*b*, 18*c*, and 18*d*. Such handle means may suitably be configured as a "U" channel member having left and right arms 18*a* and 18*b*, and having a lower cross member 18*c*. Such handle means 18 are preferably fixedly attached to the oppositely longitudinal or handle end 15 of the rigid bar 12,15 by means of an overmolding process. To facilitate secure overmolded attachment of a synthetic rubber handle 18 to the rigid bar 12,15, a plurality of laterally opening eyes 19 preferably extending through said bar's oppositely longitudinal end 15. In fabrication of the preferred overmolded a synthetic rubber handle 18, plastic melt passes beneath the rigid bar 15 to form the lower cross member 18*c* of the handle's "U" channel configuration, and passes laterally through eyes 19 to form a plurality of bar locking ties 18*d* which span between and interconnect arms 18*a* and 18*b*.

Figure 5:
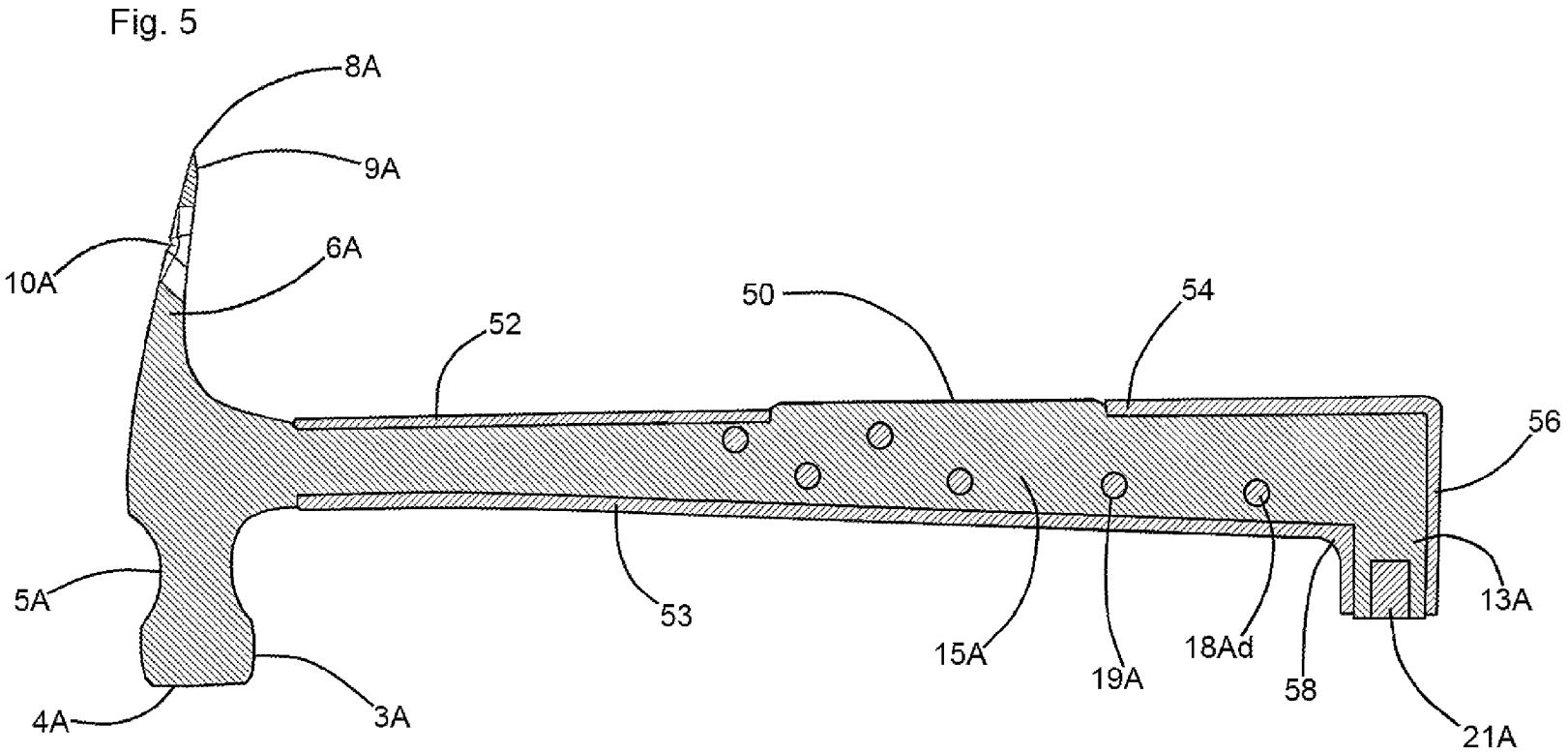
FIG. 5 presents an alternative configuration of the instant inventive carpet tack strip working tool, the sectional view being in accordance with FIG. 1's sectional view indicators.

Referring to the alternative configuration of FIG. 5, each structure identified by a reference numeral having the suffix "A" is configured substantially identically with similarly numbered structures appearing in FIGS. 1 and 3. In the FIG. 5 configuration, the overmolded synthetic rubber handle is configured to present an "0" channel rather than a "U" channel, and to advantageously create protective front and rear hand gripping surfaces 52,53 and 54,54, while presenting a localized upper strike face surface 50. In the substantially completely overmolded handle configuration of FIG. 5, an ergonomic finger protecting transition 58 is advantageously presented, and a wall surface and cabinet surface protecting buffer layer 56 is also presented.

Referring further simultaneously to FIGS. 1, 3, and 4, the instant inventive tool preferably further comprises first, second, and third strike faces which are respectively configured as a first and longitudinal nail driving face 4, a second and oppositely longitudinal nail driving face 17,21*s*, and hammer strike face or third face 14*s*. Correlating first, second, and third means for mounting the first, second, and third faces 3,17,21*s*, and 14*s* upon the rigid bar 12,15 are preferably provided. In the preferred embodiment, the first mounting means comprise a hammerhead 3 and neck combination 5, the neck 5 extending and downwardly positioning the hammerhead 3 and its face 4 from the extreme longitudinal end of the rigid bar 12,15. The second mounting means preferably comprise a second hammerhead and neck combination 16 and 13, such combination's neck 13 similarly downwardly extending hammerhead 16 and face 17,21*s* from the extreme oppositely longitudinal end of the rigid bar 12,15.

The downward extensions effected by necks 5 and 13 of the hammerheads 3 and 16 and faces 4 and 17,21*s* advantageously form and define a downwardly opening finger protection concavity 20. In order to assure that such concavity 20 defines a space large enough to protect a carpet layer's fingers 40, neck 13 is preferably sized to provide at least inch of clearance between strike face 17,21*s* and the lower surface of the handle's "U" channel cross member 18*c*.

Referring to all figures, third means for mounting the third strike face 14*s* upon the rigid bar 12,15 are also provided, such means preferably comprising an upward extension 14*e* of the handle portion 15 of the rigid bar 12,15. Such third mounting means preferably wholly forms the third strike face 14*s* with the upper end of the rigid bar 15, and such means preferably substantially horizontally orients face 14*s* for receipts of downwardly directed strikes of a separate hammer 30. The upward extension 14*e* preferably positions strike face 14*s* at an elevation slightly above the upper or distal ends of the handle's "U" member arms 18*a* and 18*b*, such height differential preferably being between 0.03 inches and 0.09 inches. Such extension differential advantageously avoids presentation of an uncomfortable ridge against a carpet layer's palm while avoiding handle damaging contacts between the separate hammer 30 and the handle's arms 18*a* and 18*b*.

The instant inventive carpet tack strip working tool 1 preferably further comprises a fourth strike face which is configured as a sharp carpet tack strip cutting edge 8. Fourth mounting means are also provided, such means preferably comprising an upwardly extending adz blade 6 having a cutting edge forming bevel 9 at its upper end. An internally beveled eye 10 preferably passes through adz blade 6, such eye 10 being specially adapted for receipt and pulling of carpet tack strip nails.

In use of the inventive tool 1, a carpet layer may grasp handle 18 and may utilize the tool 1 in the manner of a conventional hammer. Floor level directed tack strip mounting hammer strokes (which swing the tool 1 along with the carpet layer's hand and fingers toward the floor surface) are protected from injurious finger/floor contacts by the downward strike face extensions which are provided by necks 5 and 13. Those necks, in combination with bar 12,15 and the handle 18 protectively house the carpet layer's fingers 40 within the downwardly opening concavity 20.

Referring in particular simultaneously to FIGS. 1 and 4, in the event that the carpet layer wishes to cut a carpet tack strip 27 to a fitted length, the carpet layer may invert the tool 1 so that adz blade 6, bevel 9, and cutting edge 8 extend downwardly. Thereafter, the carpet layer may swing the tool downwardly against the carpet tack strip, creating a measured cut 23.

In the event that wall to wall carpeting is to be stretched over a floor 22 which is bounded by a cabinet 26 having a lower toe kick recess 28, a carpet tack strip 24 is often desirably preliminarily installed within the toe kick recess 28. Where the tack strip 24 includes a series of preliminarily set mounting nails 25, the carpet layer may grasp the tool 1 with one of his or her hands while resting the tool's longitudinal strike face 4 upon floor 22. Thereafter, the carpet layer may extend the oppositely longitudinal end of the tool 1 into toe kick recess 28 until the oppositely longitudinal strike face 17,21*s* of the hammerhead and neck combination 16,13 directly overlies and rests in contact with the head of nail 25. Thereafter, the carpet layer, while steadying the tool 1 with the one hand, may utilize the other hand to swing a second hammer 30 downwardly toward the tool 1 and against its third strike face 14*s*. Upon such striking contact, nailing force is effectively translated by the tool 1 from the hammer 30 to the nail 25 within the toe kick recess 28, effectively driving the nail 25 and mounting the carpet tack strip 24 upon floor 22 within recess 28.

Carpet layers commonly undertake a slightly different toe kick tack strip mounting task where a length of carpet tack strip 27 does not include preset floor mounting nails. In such circumstance, the carpet tack strip fails to perform a needed preliminary nail holding function, and such circumstances require the use of other means for preliminarily vertically holding the nails. Individually presetting nails within a carpet tack strip is time consuming, and holding nails with pliers or fingers within a toe kick space 28 is awkward and cumbersome. In order to overcome such difficulties, the invention's second mounting means are preferably adapted to securely hold a steel permanent magnet 21 within and as a part of hammerhead 16. The magnet 21 is preferably cylindrical, having a circular cross sectional shape, and such magnet is preferably securely mounted within a downwardly opening cylindrical socket within the hammerhead 16. The lower surface 21*s* of the magnet 21 is preferably flush with or coextensive with the lower strike surface 17 of the hammerhead 16, such flush character providing a continuous and magnetic strike face 17,21*s*. Carpet tack strip nails, such as nail 32, may be held by the magnet 21 against the strike face 17,21*s*. Such magnetic attachment effectively preliminarily holds the nail 32 for toe kick recess nail driving via strokes of hammer 30 in the manner described above.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A carpet tack strip working tool comprising:

(a) a rigid bar having longitudinal, oppositely longitudinal, upper, and lower ends;

(b) a handle fixedly attached to or formed wholly with the rigid bar's oppositely longitudinal end;

(c) first, second, and third strike faces, the first and second strike faces being adapted for carpet tack strip nailing, and the third strike face being adapted for hammer striking;

(d) a first hammerhead and neck combination, a second hammerhead and neck combination, and an extension respectively fixedly attaching the first, second, and third strike faces to the rigid bar, the first hammerhead and neck combination downwardly extending the first strike face from the rigid bar's longitudinal end, the second hammerhead and neck combination downwardly extending the second strike face from the rigid bar's oppositely longitudinal end, and the extension upwardly extending the third strike face from the rigid bar's oppositely longitudinal end; and (e) a downwardly opening finger protection concavity, said concavity underlying the handle and being oppositely longitudinally bounded by the second hammerhead and neck combination's downward extension; and further comprising a fourth strike face adapted for carpet tack strip cutting, and further comprising a blade, the blade upwardly extending the fourth strike face from the rigid bar's longitudinal end.

2. The carpet tack strip working tool of claim 1 wherein the blade comprises an adz blade.

3. The carpet tack strip working tool of claim 2 further comprising a nail pull eye, said eye opening at the adz blade.

4. The carpet tack strip working tool of claim 1 wherein the handle has an upper end, and wherein the extension is adapted to upwardly expose the third strike face at said upper end.

5. The carpet tack strip working tool of claim 4 further comprising a permanent magnet having a lower strike face end, the second hammerhead and neck combination being adapted for holding the permanent magnet and for exposing the lower strike face at the second strike face.

6. The carpet tack strip working tool of claim 1 wherein the handle comprises a channel member, said member nestingly receiving the rigid bar.

7. The carpet tack strip working tool of claim 6 wherein the rigid bar comprises steel, and wherein the channel member comprises a synthetic rubber overmold incorporating the rigid bar.

8. The carpet tack strip working tool of claim 7 further comprising a plurality of eyes, said eyes laterally opening the rigid bar within the channel member's channel, the channel member's synthetic rubber overmold engaging said eyes.

* * * * *